US011295694B2

(12) United States Patent
Wang

(10) Patent No.: US 11,295,694 B2
(45) Date of Patent: Apr. 5, 2022

(54) DISPLAY DEVICE

(71) Applicants: CHONGQING HKC OPTOELECTRONICS TECHNOLOGY CO., LTD., Chongqing (CN); HKC Corporation Limited, Guangdong (CN)

(72) Inventor: Mingliang Wang, Chongqing (CN)

(73) Assignees: CHONGQING HKC OPTOELECTRONICS TECHNOLOGY CO., LTD., Chongqing (CN); HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/294,879

(22) PCT Filed: May 6, 2020

(86) PCT No.: PCT/CN2020/088739
§ 371 (c)(1),
(2) Date: May 18, 2021

(87) PCT Pub. No.: WO2020/224583
PCT Pub. Date: Nov. 12, 2020

(65) Prior Publication Data

US 2022/0005434 A1 Jan. 6, 2022

(30) Foreign Application Priority Data

May 6, 2019 (CN) ..... 201910371188.3

(51) Int. Cl.
*G09G 3/36* (2006.01)

(52) U.S. Cl.
CPC ..... *G09G 3/3696* (2013.01); *G09G 3/3688* (2013.01); *G09G 2310/027* (2013.01); *G09G 2320/0673* (2013.01)

(58) Field of Classification Search
CPC ..... G09G 3/3688; G09G 3/3696; G09G 2310/027; G09G 2320/0673
See application file for complete search history.

(56) References Cited

U.S. PATENT DOCUMENTS 6,870,322 B1 3/2005 Mizukoshi et al.
7,742,029 B2 6/2010 Jung et al.
(Continued)

FOREIGN PATENT DOCUMENTS

CN 1846243 A 10/2006
CN 1897093 A 1/2007
(Continued)

OTHER PUBLICATIONS

Chinese Office Action for Application No. 201910371188.3 dated Jan. 4, 2021, 5 pages.
(Continued)

*Primary Examiner* — Kenneth B Lee, Jr.
(74) *Attorney, Agent, or Firm* — Hauptman Ham, LLP

(57) ABSTRACT

A display device, comprising: a power supply chip configured to output a gate-on voltage; a gamma chip configured to output a gamma voltage; a detection resistor having a first terminal and a second terminal, wherein the first terminal is grounded; a display panel comprising a plurality of sub-pixels, a plurality of driving transistors, and at least one detection transistor; a control circuit electrically connected to the second terminal of the detection resistor, and configured to control the gamma chip to increase the output of the gamma voltage when a voltage of the detection resistor decreases.

15 Claims, 4 Drawing Sheets

(56) References Cited

U.S. PATENT DOCUMENTS

| | | | | |
|---|---|---|---|---|
| 8,049,692 | B2 * | 11/2011 | Kim | G09G 3/3655 345/87 |
| 9,214,107 | B2 | 12/2015 | Fish et al. | |
| 2010/0033415 | A1 * | 2/2010 | Bae | G09G 3/3696 345/94 |
| 2015/0325169 | A1 | 11/2015 | Qing et al. | |
| 2018/0096666 | A1 * | 4/2018 | Chung | G09G 3/3688 |
| 2019/0206333 | A1 * | 7/2019 | Kim | G06F 3/0412 |

FOREIGN PATENT DOCUMENTS

| | | | |
|---|---|---|---|
| CN | 101449311 | A | 6/2009 |
| CN | 102446475 | A | 5/2012 |
| CN | 104280970 | A | 1/2015 |
| CN | 104900186 | A | 9/2015 |
| CN | 207097427 | U | 3/2018 |
| CN | 109425816 | A | 3/2019 |
| CN | 110288956 | A | 9/2019 |
| CN | 110322850 | A | 10/2019 |

OTHER PUBLICATIONS

International Search Report for Application No. PCT/CN2020/088739 dated Aug. 5, 2020, 4 pages.

* cited by examiner

DISPLAY DEVICE

CROSS REFERENCE TO RELATED APPLICATIONS

This is a U.S. National Stage application of, and claims priority to, PCT/CN2020/088739, filed May 6, 2020, which further claims priority to Chinese Patent Application No. 201910371188.3, filed May 6, 2019, the disclosures of which are incorporated herein by reference in their entirety.

TECHNICAL FIELD

The present disclosure relates to the field of display technology, and especially to a display device.

BACKGROUND

This section provides background information related to the present disclosure which is not necessarily prior art.

With the development of display technology, various display devices (e.g., liquid crystal television) are used in work and life of people, providing convenience for people. Generally, each imaging sub-pixel of a display device is driven via a thin film transistor (TFT). Such a TFT type display device has advantages of high responsivity, high brightness, high contrast and etc., and thus has currently become the most popular display device.

However, a thin film transistor inside such a display device would gradually age with long term use, which would lead to insufficient charging of its sub-pixels for display. As such, there will be a problem of dark display, and thus the service life of the device will be adversely affected.

SUMMARY

According to various embodiments of the present disclosure, a display device is provided.

A display device includes:

a power supply chip configured to output a gate-on voltage;

a gamma chip configured to output a gamma voltage;

a detection resistor having a first terminal and a second terminal for electrical connection, wherein the first terminal is grounded;

a display panel including a plurality of sub-pixels, a plurality of driving transistors, and at least one detection transistor, wherein a gate of the driving transistor receives the gate-on voltage, a first electrode of the driving transistor receives the gamma voltage, and a second electrode of the driving transistor is electrically connected to a corresponding sub-pixel, a gate of the detection transistor receives the gate-on voltage, a first electrode of the detection transistor receives a test voltage, and a second electrode of the detection transistor is electrically connected to the second terminal of the detection resistor;

a control circuit electrically connected to the second terminal of the detection resistor, and configured to control the gamma chip to increase the output of the gamma voltage when a voltage of the detection resistor decreases.

A display device includes:

a gamma chip including a digital-to-analog conversion circuit and two voltage storage circuits, each voltage storage circuit stores a different voltage code, and the digital-to-analog conversion circuit is configured to convert the voltage code into the gamma voltage for outputting;

a data driving chip electrically connected to the gamma chip, and configured to output the gamma voltage according to a certain timing sequence;

a power supply chip configured to output a gate-on voltage and a power supply voltage of the data driving chip;

a detection resistor having a first terminal and a second terminal, wherein the first terminal is grounded;

a display panel including a plurality of sub-pixels, a plurality of driving transistors, and at least one detection transistor, wherein a gate of the driving transistor receives the gate-on voltage, a first electrode of the driving transistor receives the gamma voltage, and a second electrode of the driving transistor is electrically connected to a corresponding sub-pixel, a gate of the detection transistor receives the gate-on voltage, a first electrode of the detection transistor receives the power supply voltage of the data driving chip, and a second electrode of the detection transistor is electrically connected to the second terminal of the detection resistor;

two switches arranged in one-to-one correspondence with the voltage storage circuits, wherein both terminals of the switch has two terminals are electrically connected to the corresponding voltage storage circuit and the digital-to-analog conversion circuit, respectively, the two switches are both electrically connected to the second terminal of the detection resistor, and are switched on and off with opposite states according to the voltage of the detection resistor;

when the voltage of the detection resistor is lower than a preset voltage value, the two switches switch on and off states so as to increase the output of the gamma voltage.

According to the aforementioned display device, due to the adding of the detection resistor and the detection transistor, the aging condition of the detection transistor can be detected according to the reduction of the voltage of the detection resistor, and the aging state of each driving transistor can be effectively reflected by the aging status of the detection resistor. Meanwhile, the aforementioned display device controls the gamma chip to increase the output of the gamma voltage when the voltage of the detection resistor decreases, such that the voltage of the first electrode of each driving transistor can be increased when the impedance of the driving transistor increases due to its aging, and it can effectively prevent the current of the second electrode (the actual charging current) of each driving transistor from decreasing, and thus guaranteeing the brightness consistency of the display device during long-term use. Therefore, the display device according to the present disclosure can be effectively prevented from dimming in display due to long-term use.

DETAILED DESCRIPTION

The above objects, features and advantages of the present invention will become more apparent by describing in detail embodiments thereof with reference to the accompanying drawings. It should be understood that, the specific embodiments described herein are merely exemplary and not intended to limit this application.

A display device as provided in the present disclosure can be applied to a liquid crystal television, a computer monitor, and etc.

Figure 1:
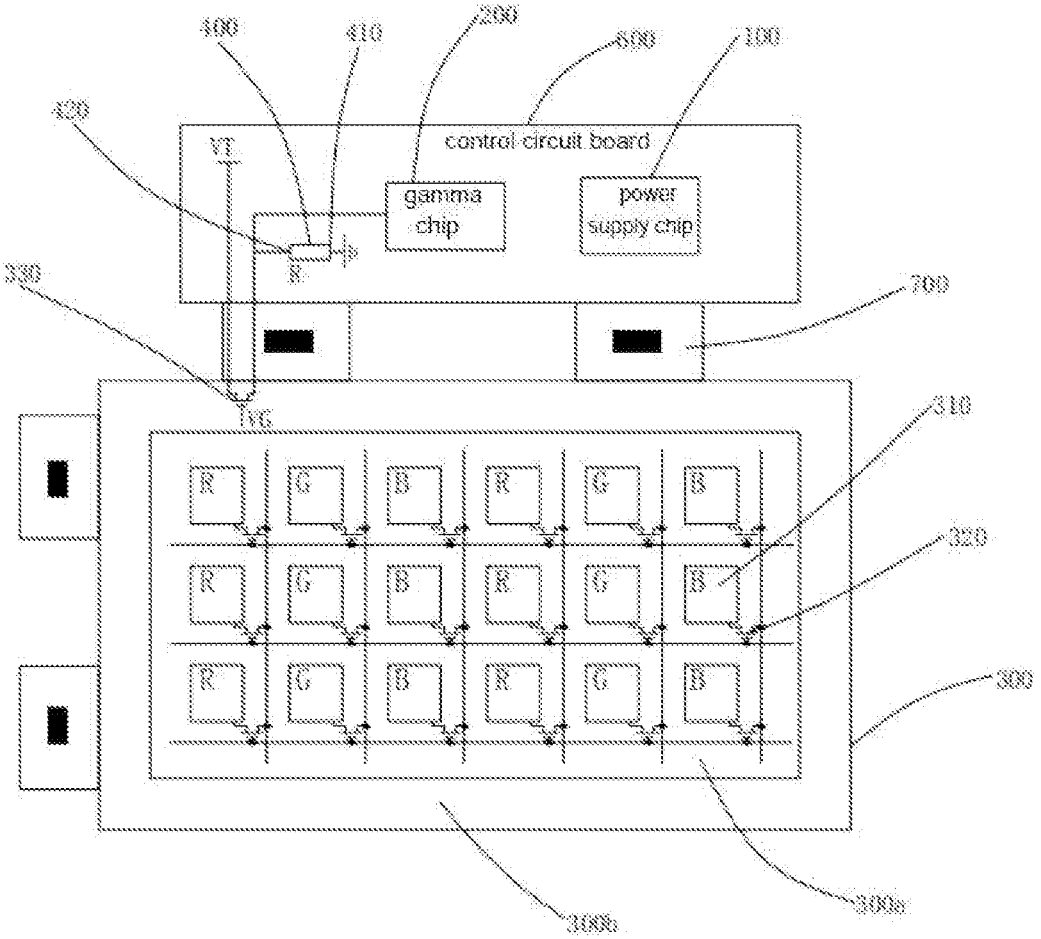
FIG. 1 is a schematic view of a display device of an embodiment.

Referring to FIG. 1, in an embodiment, the display device includes a power supply chip 100, a gamma chip 200, and a display panel 300. The power supply chip 100 is configured to output a gate-on voltage VG. The gamma chip 200 is configured to output a gamma voltage.

Figure 2:
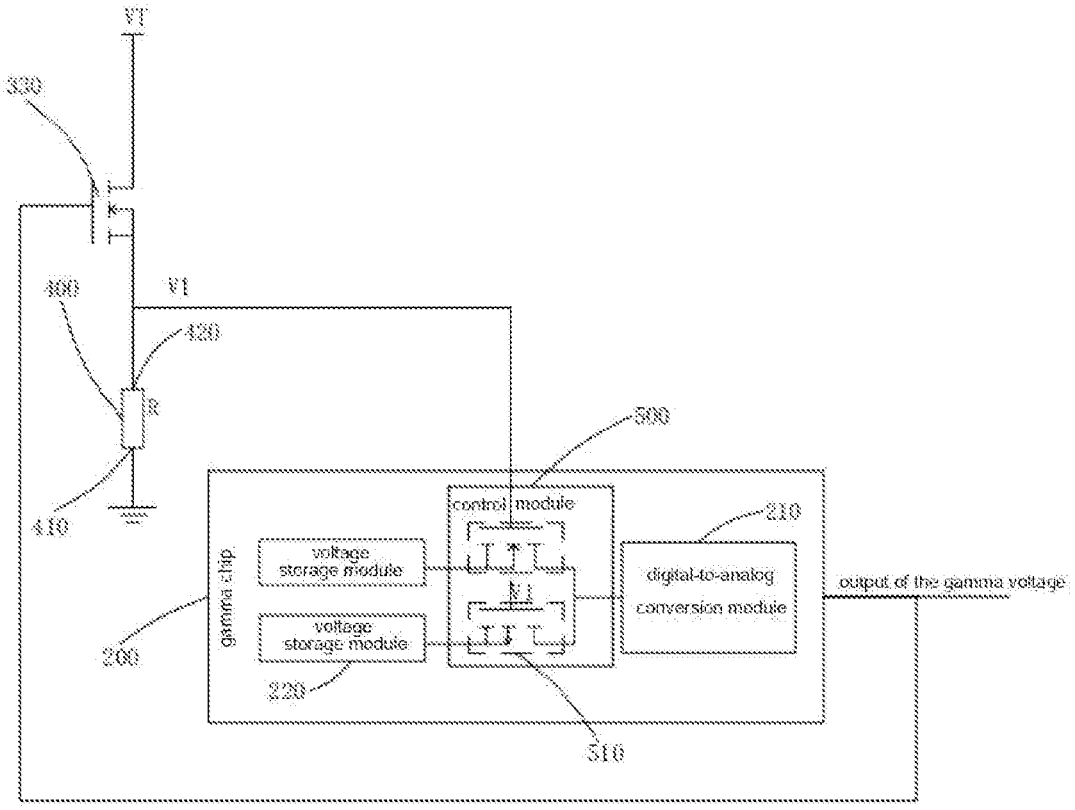
FIG. 2 is a partial enlarged view of the display device of FIG. 1.

Referring to FIG. 2, the display panel 300 includes a plurality of sub-pixels 310 of various colors, such as red sub-pixel R, green sub-pixel G, and blue sub-pixel B. Meanwhile, the display panel 300 further includes a plurality of driving transistors 320 configured to drive the sub-pixels 310. The driving transistor 320 can be a thin film transistor. Specifically, a gate of each driving transistor 320 receives a gate-on voltage VG, so as to turn on a corresponding sub-pixel 310. A first electrode of each driving transistor 320 receives the corresponding gamma voltage to provide a power for a corresponding sub-pixel 310. Further, a second electrode of each driving transistor 320 is electrically connected to a corresponding sub-pixel 310, so as to charge the corresponding sub-pixel 310. Specifically, each sub-pixel 310 includes a pixel electrode, a common electrode, liquid crystal molecules between the pixel electrode and the common electrode, and the like. Each sub-pixel 310 corresponds to a pixel electrode, and various sub-pixels can share a common electrode. The second electrode of each driving transistor 320 is electrically connected to a corresponding sub-pixel 310. Specifically, the second electrode of the driving transistor 320 is electrically connected to the pixel electrode of the corresponding sub-pixel 310.

The first electrode used herein can be a drain electrode or a source electrode; correspondingly, the second electrode can be a source electrode or a drain electrode. Specifically, in case that the driving transistor is an N-type transistor, the first electrode is a drain electrode, and the second electrode is a source electrode. In case that the driving transistor is a P-type transistor, the first electrode is a source electrode, and the second electrode is a drain electrode. In the embodiment illustrated in FIG. 2, the driving transistor is an N-type transistor.

In addition, in this embodiment, the display panel further includes at least one detection transistor 330. The detection transistor 330 is configured to perform an aging detection. The detection transistor 330 and the driving transistor 320 can be the thin film transistors of the same conductivity type and formed by the same process, such that the two can have same performance parameters, and thus the aging condition of the detection transistor 330 can relatively precisely reflect the aging condition of the driving transistor 320. The conductivity type refers to the type of the majority carrier in the conducting channel when the thin film transistor is turned on.

In order to implement the aging detection of the detection transistor 330, the display device further includes a detection resistor 400. The detection resistor 400 is a resistor with a constant resistance, and has a first terminal 410 and a second terminal 420 for electrical connection. The first terminal 410 is grounded, and the second terminal 420 is electrically connected to a second electrode of the detection transistor 330.

Meanwhile, the gate of the driving transistor 320 is identical to the gate of the detection transistor 330, which also receives the gate-on voltage VG to form a conducting channel. The first electrode of the detection transistor 330 receives a test voltage VT, so as to form a current path in the conducting channel between its first electrode and second electrode. The test voltage VT can be directly output by the power supply chip 100, or, of course, can be output by another driving part.

An equivalent impedance of the detection transistor 330 is set to be R1, an impedance of the detection resistor 400 is set to be R, the test voltage VT is set to be VDD, and a voltage across the detection resistor 400 is set to be V1. As such, when there is only one detection transistor 330, $V1=VDD*R/(R+R1)$. Accordingly, V1 is negatively correlated with R1. Just like the driving transistor 320, the detection transistor 330 will gradually age with the use of the display device, and its equivalent impedance R1 will gradually increase. Accordingly, as this transistor ages, V1 will become smaller and smaller. As such, the aging degree of the detection transistor 330 can be detected from V1, which can in turn reflect the aging degree of the driving transistor 320.

Referring to FIG. 2, in this embodiment, the display device further includes a control circuit 500. The control circuit 500 is electrically connected to the second terminal 420 of the detection resistor 400, and thus it can control the gamma chip 200 to output different gamma voltages according to the voltage of the detection resistor 400.

The driving transistor 320 and the detection transistor 330 are located in a same display device, both of which receive the same gate-on voltage VG. Therefore, the two have a similar aging degree. The aging condition of the detection transistor 330 can reflect the aging condition of the driving transistor. When the voltage of the detection resistor 400 decreases, it means that the impedances of the detection transistor 330 and the driving transistor 320 increase due to aging. In this case, the control circuit 500 controls the gamma chip 200 to increase the output of the gamma voltage, such that the voltage across the first electrode of the driving transistor 320 will increase when the impedance of the driving transistor 320 itself increases due to its aging, which can effectively prevent the second electrode current (i.e., the actual charging current) of the driving transistor 320 flowing to a sub-pixel from decreasing. As such, the present disclosure can effectively prevent the display device from dimming in brightness after long-term use.

In an embodiment, the gamma chip 200 includes a digital-to-analog conversion circuit 210 and two voltage storage circuits 220. Each voltage storage circuit 220 is a storage circuit (e.g., a memory) with a prewritten and stored voltage code. The digital-to-analog conversion circuit 210 is configured to convert a voltage code into the gamma voltage for outputting.

Meanwhile, the control circuit 500 includes two switches 510. The two switches 510 are arranged in one-to-one correspondence with the two voltage storage circuits 220. Both terminals of each switch unit 510 are electrically connected to its corresponding voltage storage circuit 220 and the digital-to-analog conversion circuit 210, respectively, so as to control an on-off state between each voltage storage circuit 220 and the digital-to-analog conversion circuit 210, respectively. The two switches 510 can be disposed on the gamma chip 200, or, of course, they can be disposed in other positions.

The two switches 510 are both electrically connected to the second terminal of the detection resistor 400 so as to receive the voltage V1 signal of the detection resistor 400.

Meanwhile, in this embodiment, the two switches 510 are switched on and off with opposite states according to the voltage V1 of the detection resistor 400, such that each switch unit 510 is switched on and off directly according to the magnitude of the voltage across the detection resistor 400, and thus the structure of the system circuit can be simplified.

Specifically, the two switches 510 can be configured as two transistors of opposite conductivity types, respectively. That is, one of the switches 510 is a P-type transistor (specifically, can be a P-type metal oxide semiconductor field effect (MOS) transistor), and the other switch 510 is an N-type transistor (specifically, can be an N-type metal oxide semiconductor field effect (MOS) transistor). The opposite conductivity types indicate that the types of the majority carriers in conducting channels are opposite, e.g., the conductive majority carriers in the conducting channel of the P-type transistor are holes, and the conductive majority carriers in the conducting channel of the N-type transistor are electrons.

When the display device just begins to be used, since the detection transistor 300 is not aged or has a low degree of aging, the voltage V1 of the detection resistor 400 is relatively high or at a high level. At this point, the N-type transistor is turned on and the P-type transistor is turned off, such that the voltage storage circuit 220 electrically connected to the N-type transistor is connected to the digital-to-analog conversion circuit 210, thereby outputting an initial gamma voltage.

After the display device has been used for a period of time, the detection transistor 330 becomes seriously aged, and the voltage V1 of the detection resistor 400 becomes relatively low or at a low level. At this point, the N-type transistor is turned off and the P-type transistor is turned on, such that the voltage storage circuit 220 electrically connected to the P-type transistor is connected to the digital-to-analog conversion circuit 210, thereby outputting a gamma voltage with a larger voltage value. Of course, the two switches 510 can also be configured in other forms, which are not limited hereto.

Of course, in the embodiment of the present disclosure, the on-off of each switch 510 can also be controlled by other means.

Figure 3:
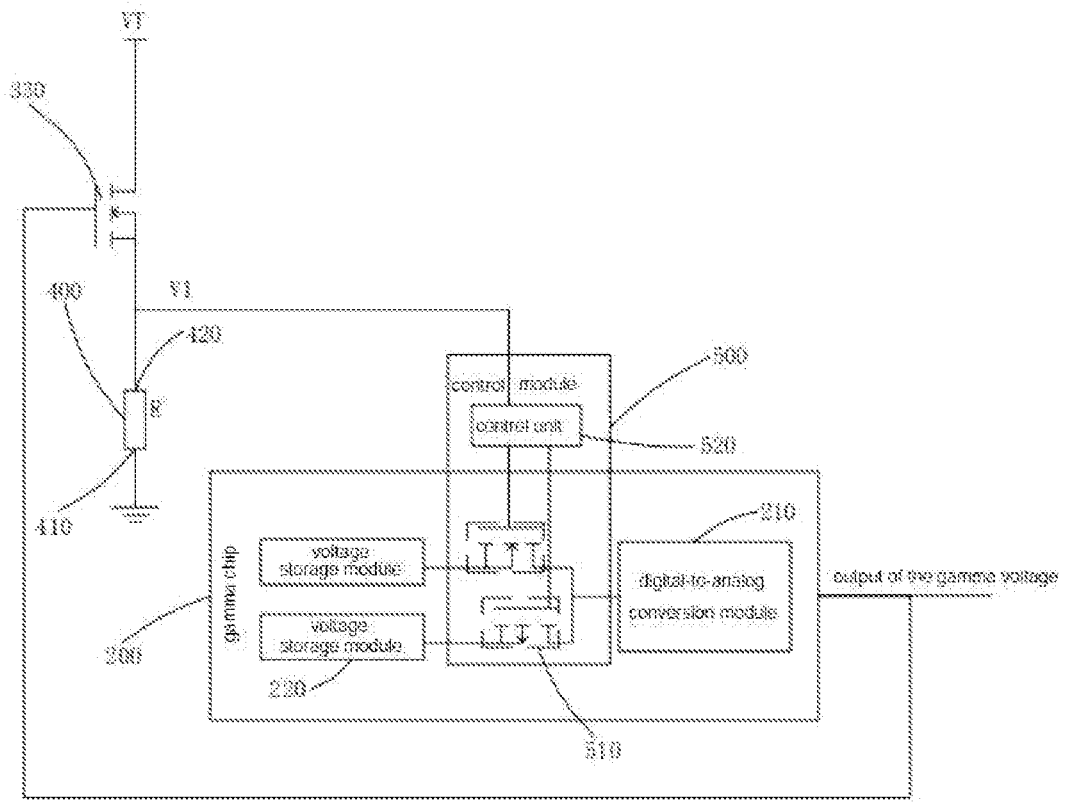
FIG. 3 is a partial enlarged view of a display device of another embodiment.

In another embodiment, referring to FIG. 3, the gamma chip 200 includes a digital-to-analog conversion circuit 210 and at least two voltage storage circuits 220. Each voltage storage circuit 210 is configured to store a different voltage code. Meanwhile, the control circuit 500 correspondingly includes switches 510 of the same number as the voltage storage circuits. The switches 510 are arranged in one-to-one correspondence with the voltage storage circuits 220. Both terminals of each switch unit 510 are electrically connected to a corresponding voltage storage circuit 220 and the digital-to-analog conversion circuit 210, respectively.

In addition, the control circuit 500 further includes a controller 520. The controller 520 can be electrically connected to the second terminal 420 of the detection resistor 400, so as to acquire the voltage of the detection resistor 400. When the voltage of the detection resistor 400 is lower than a preset voltage value, the controller 520 switches off the switch unit 510, such that the gamma voltage output by the digital-to-analog conversion circuit 210 after the switch unit 510 is switched off is greater than the gamma voltage output by the digital-to-analog conversion circuit 210 before the switch 510 is switched off. "The preset voltage value" here can be configured as required.

Specifically, when the display device begins to be used, the voltage V1 of the detection resistor 400 is greater than the preset voltage value. At this point, one of the switches 510 is switched off, such that a corresponding voltage storage circuit 220 is electrically connected to the digital-to-analog conversion circuit 210, and the voltage code is converted into the initial gamma voltage via the digital-to-analog conversion circuit 210 for outputting.

After the display device has been used for a period of time, the voltage V1 of the detection resistor 400 is lower than the preset voltage value. At this point, the control circuit 500 switches off another switch 510, such that another corresponding voltage storage circuit 220 is electrically connected to the digital-to-analog conversion circuit 210 to output another increased gamma voltage, thereby preventing the display device from dimming.

When the number of the switches 510 is more than two, likewise, after the display device has been used for a further period of time, the voltage V1 of the detection resistor 400 becomes lower than the preset voltage value once again. At this point, the control circuit 500 switches off a yet another switch 510, such that yet another corresponding voltage storage circuit 220 is electrically connected to the digital-to-analog conversion circuit 210 to output a further greater gamma voltage, thereby preventing the display device from dimming.

By analogy, whenever the voltage of the detection resistor 400 is lower than the preset voltage value, the controller 520 changes from switching off one switch 510 to switching off another different switch 510, so as to output a greater gamma voltage.

Accordingly, in this embodiment, the controller 520 cooperates with the switches 510 to control the display device to apply a different gamma voltage in a different period of use in a simple and easy manner and thus achieve a consistent brightness. That is, the brightness of the display device can be effectively prevented from becoming lower after long term use.

Of course, the control method of the controller 520 to the switches 510 can be different from that as described above.

Figure 4:
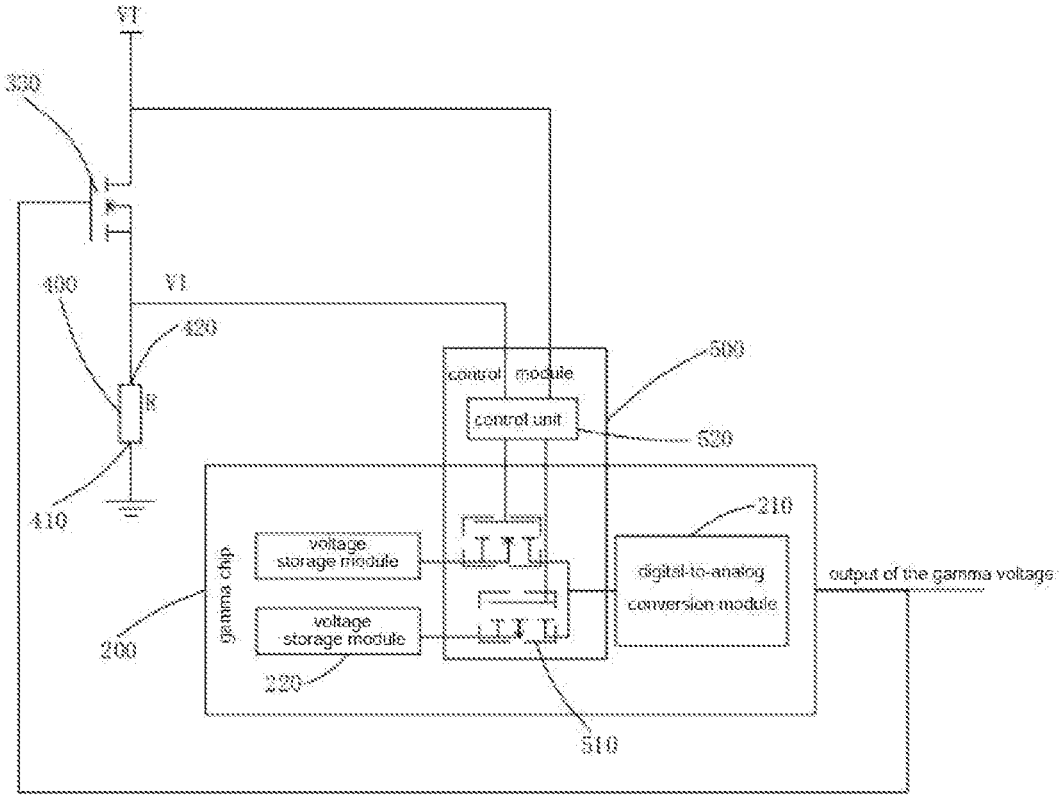
FIG. 4 is a partial enlarged view of a display device of yet another embodiment.

For example, referring to FIG. 4, in another embodiment, in addition to acquire the voltage of the detection resistor 400, the controller 520 further acquires a test voltage VT. When the test voltage VT is output by the power supply chip 100, the controller 520 can be electrically connected to the power supply chip 100 to acquire the test voltage VT.

After acquiring the voltages, the controller 520 calculates a voltage difference dV between the test voltage VT and the voltage of the detection resistor 400, and controls the on and off of each switch 510 according to the voltage difference dV. Specifically, the voltage value of the test voltage VT is constant, and the voltage V1 of the detection resistor 400 decreases as the detection transistor 330 ages. As a result, the voltage difference dV between the test voltage VT and the voltage of the detection resistor 400 increases as the detection transistor 330 ages.

Accordingly, it can be configured that, whenever the voltage difference dV between the test voltage VT and the voltage of the detection resistor 400 is greater than a preset voltage difference value, the controller 520 changes from switching off one switch unit 510 to switching off another switch 510, such that the gamma voltage output by the digital-analog conversion circuit 210 after the switch 510 is switched off is greater than the gamma voltage output by the digital-analog conversion circuit 210 before the switch 510 is switched off. "The preset voltage difference value" used herein can be configured as required.

In an embodiment, the display device further includes a control circuit board 600. The power supply chip 100, the gamma chip 200, and the detection resistor 400 are all disposed on the control circuit board 600. That is, the detection resistor 400 can be disposed on a control circuit board 600 where the power chip 100 and the gamma chip 200 are located, so as to facilitate the circuit layout of the resistor.

In an embodiment, the display panel 300 has a display area 300*a* and a non-display area 300*b* surrounding the display area 300*a*. The sub-pixels 310 and the driving transistors 320 are located in the display area 300*a*, and thus can be displayed in the display area. The detection transistor 330 is located in the non-display area 300*b*, so as to reduce its influences to the wiring, light emission and etc. of the display area 300*a*.

In an embodiment, the display device further includes a data driving chip 700. The data driving chip 700 is electrically connected to the gamma chip 200 and the driving transistors 320, so as to output the gamma voltage from the gamma chip 200 to the driving transistors 320 according to a certain timing sequence.

The power supply voltage (usually 3.3V) of the data driving chip 700 is output by the power supply chip 100, which is close to the gamma voltage (usually 0-14V) output for normal displaying. Accordingly, in this embodiment, the power supply voltage of the data driving chip 700 is taken as the test voltage VT. On one hand, it is not necessary to output an additional voltage, which makes the system more compatible. On the other hand, the detection transistor 330 has a closer operation condition to that of the driving transistor 320, and thus the aging of the detection transistor 330 can reflect the aging condition of the driving transistor 320 more accurately.

In an embodiment, in order to increase the reliability of detection, the number of the detection transistor 330 can be more than one. Specifically, for example, three identical detection transistors 330 can be provided, which are connected in parallel and then connected to the detection resistor 400 in series. In this case, the voltage applied on the detection resistor satisfies $V1=VDD*R/(R+\frac{1}{3}R1)$, where R1 is the equivalent impedance of each detection transistor 330, R is the impedance of the detection resistor 400, and VDD is the test voltage VT. As such, the aging condition of each driving transistor 320 can be determined according to the average aging condition of the three detection transistors 330, and thus the reliability of detection is increased.

In an embodiment, the display device includes a gamma chip 200, a data driving chip 700, a power supply chip 100, a detection resistor 400, a display panel 300, and two switches 510.

The gamma chip 200 includes a digital-to-analog conversion circuit 210 and two voltage storage circuits 220. Each voltage storage circuit 220 stores a different voltage code. The digital-to-analog conversion circuit 210 is configured to convert the voltage code into the gamma voltage for outputting. The data driving chip 700 is electrically connected to the gamma chip 200. The gamma chip 200 can output gamma voltages according to a certain timing sequence. The power supply chip 100 is configured to output a gate-on voltage VG and the power supply voltage of the data driving chip 700. The detection resistor 400 has a first terminal 410 and a second terminal 420 for electrical connection. The first terminal 410 is grounded.

The display panel 300 includes a plurality of sub-pixels 310, a plurality of driving transistors 320, and at least one detection transistor 330. A gate of the driving transistor 320 receives the gate-on voltage VG. A first electrode of the driving transistor 320 receives the gamma voltage. A second electrode of the driving transistor is electrically connected to a corresponding sub-pixel 310. A gate of the detection transistor 330 receives the gate-on voltage VG. A first gate of the detection transistor 330 receives the power supply voltage of the data driving chip 700. A second electrode of the detection transistor 300 is electrically connected to the second terminal of the detection resistor 400.

The switches 510 are arranged in correspondence with the voltage storage circuits 220. Both terminals of each switch circuit 510 are electrically connected to a corresponding voltage storage circuit 220 and the digital-to-analog conversion circuit 210, respectively. The two switches 510 are both electrically connected to the second terminal 420 of the detection resistor 400, and are switched on and off with opposite states according to the voltage of the detection resistor 400.

When the voltage of the detection resistor 400 is lower than the preset voltage value, the two switches 510 switch on and off states, so as to switch the voltage storage circuit 220 electrically connected to the digital-to-analog conversion circuit 210, and thus increase the output of the gamma voltage. As such, in this embodiment, when the driving transistors 320 are seriously aged due to long term use of the display device, the output of the gamma voltage can be increased to prevent the brightness from decreasing.

The technical features in the above embodiments can be combined in any manner. In an effort to provide a concise description, not all of the possible combinations of the technical features in the above embodiments are described. However, any combination of these technical features should be considered within the scope as recited in this specification unless there is a contradiction in such a combination.

The embodiments as described above merely express several implementations of the present application, the description of which is relatively specific and detailed and should not be understood as a limitation to the scope of the invention. It should be pointed out that, it is possible for those skilled in the art to make several modifications and improvements to this application without departing from the concept of it, all of which are within the protection scope of this application. Therefore, the protection scope of this application shall be subject to that of the appended claims.

What is claimed is:

1. A display device, comprising:

a power supply chip configured to output a gate-on voltage;

a gamma chip configured to output a gamma voltage;

a detection resistor having a first terminal and a second terminal, wherein the first terminal is grounded;

a display panel comprising a plurality of sub-pixels, a plurality of driving transistors, and at least one detection transistor, wherein a gate of the driving transistor receives the gate-on voltage, a first electrode of the driving transistor receives the gamma voltage, and a second electrode of the driving transistor is electrically connected to a corresponding sub-pixel, a gate of the detection transistor receives the gate-on voltage, a first electrode of the detection transistor receives a test voltage, and a second electrode of the detection transistor is electrically connected to the second terminal of the detection resistor;

a control circuit electrically connected to the second terminal of the detection resistor, and configured to control the gamma chip to increase the output of the gamma voltage when a voltage of the detection resistor decreases.

2. The display device according to claim 1, wherein the gamma chip comprises a digital-to-analog conversion circuit and two voltage storage circuits, each voltage storage circuit stores a different voltage code, and the digital-to-analog conversion circuit is configured to convert each voltage code into the gamma voltage for outputting;

the control circuit module comprises two switches, the switches are arranged in one-to-one correspondence with the voltage storage circuits, both terminals of the switch are electrically connected to the corresponding voltage storage circuit and the digital-to-analog conversion circuit, respectively, the two switches are both electrically connected to the second terminal of the detection resistor, and are switched on and off with opposite states according to the voltage of the detection resistor.

3. The display device according to claim 2, wherein the two switches are two transistors of opposite conductivity types, respectively.

4. The display device according to claim 3, wherein one of the switches is a P-type transistor and the other switch is an N-type transistor;

when the voltage of the detection resistor is at a high level, the N-type transistor is turned on and the P-type transistor is turned off; and when the voltage of the detection resistor is at a low level, the N-type transistor is turned off and the P-type transistor is turned on.

5. The display device according to claim 1, wherein the gamma chip comprises a digital-to-analog conversion circuit and at least two voltage storage circuits, each voltage storage circuit stores a different voltage code, and the digital-to-analog conversion circuit is configured to convert each voltage code into the gamma voltage for outputting;

the control circuit comprises a controller and switches of the same number as the voltage storage circuits, the switches are arranged in one-to-one correspondence with the voltage storage circuits, and both terminals of the switch are electrically connected to the corresponding voltage storage circuit and the digital-to-analog conversion circuit, respectively; the controller is configured to acquire the voltage of the detection resistor, and when the voltage of the detection resistor is lower than a preset voltage value, the controller switches off the switch, such that the gamma voltage output by the digital-to-analog conversion circuit after the switch is switched off is greater than the gamma voltage output by the digital-to-analog conversion circuit before the switch is switched off.

6. The display device according to claim 2, wherein the gamma chip comprises a digital-to-analog conversion circuit and at least two voltage storage circuits, each voltage storage circuit stores a different voltage code, and the digital-to-analog conversion circuit is configured to convert each voltage code into the gamma voltage for outputting;

the control circuit comprises a controller and switches of the same number as the voltage storage circuits, the switches are arranged in one-to-one correspondence with the voltage storage circuits, and both terminals of the switch are electrically connected to the corresponding voltage storage circuit and the digital-to-analog conversion circuit, respectively; the controller is configured to acquire the test voltage and the voltage of the detection resistor, and calculate a voltage difference between the test voltage and the voltage of the detection resistor, and when the voltage difference is greater than a preset voltage difference value, the controller switches off the switch, such that the gamma voltage output by the digital-to-analog conversion circuit after the switch is switched off is greater than the gamma voltage output by the digital-to-analog conversion circuit before the switch is switched off.

7. The display device according to claim 1, wherein the display device further comprises a control circuit board, and the power supply chip, the gamma chip, and the detection resistor are all disposed on the control circuit board.

8. The display device according to claim 1, wherein the display panel has a display area and a non-display area surrounding the display area, the sub-pixels and the driving transistors are located in the display area, and the detection transistor is located in the non-display area.

9. The display device according to claim 1, wherein the first electrode is a drain electrode, and the second electrode is a source electrode.

10. The display device according to claim 1, wherein the plurality of detection transistors are connected in parallel and then connected to the detection resistor in series.

11. A display device, comprising:

a gamma chip comprising a digital-to-analog conversion circuit and two voltage storage circuits, each voltage storage circuit stores a different voltage code, and the digital-to-analog conversion circuit is configured to convert the voltage code into the gamma voltage for outputting;

a data driving chip electrically connected to the gamma chip, and configured to output the gamma voltage according to a certain timing sequence;

a power supply chip configured to output a gate-on voltage and a power supply voltage of the data driving chip;

a detection resistor having a first terminal and a second terminal, wherein the first terminal is grounded;

a display panel comprising a plurality of sub-pixels, a plurality of driving transistors, and at least one detection transistor, wherein a gate of the driving transistor receives the gate-on voltage, a first electrode of the driving transistor receives the gamma voltage, and a second electrode of the driving transistor is electrically connected to a corresponding sub-pixel, a gate of the detection transistor receives the gate-on voltage, a first electrode of the detection transistor receives the power supply voltage of the data driving chip, and a second electrode of the detection transistor is electrically connected to the second terminal of the detection resistor;

two switches arranged in one-to-one correspondence with the voltage storage circuits, wherein both terminals of the switch are electrically connected to the corresponding voltage storage circuit and the digital-to-analog conversion circuit, respectively, the two switches are both electrically connected to the second terminal of the detection resistor, and are switched on and off with opposite states according to the voltage of the detection resistor;

when the voltage of the detection resistor is lower than a preset voltage value, the two switches switch on and off states so as to increase the output of the gamma voltage.

12. The display device according to claim 11, wherein the two switches are two transistors of opposite conductivity types, respectively.

13. The display device according to claim 12, wherein one of the switches is a P-type transistor, and the other switch unit is an N-type transistor;

when the voltage of the detection resistor is at a high level, the N-type transistor is turned on and the P-type transistor is turned off;

when the voltage of the detection resistor is at a low level, the N-type transistor is turned off and the P-type transistor is turned on.

14. The display device according to claim 11, wherein the display device further comprises a control circuit board, and the power supply chip, the gamma chip, and the detection resistor are all disposed on the control circuit board.

15. The display device according to claim 11, wherein the display panel has a display area and a non-display area surrounding the display area, the sub-pixels and the driving transistors are located in the display area, and the detection transistor is located in the non-display area.

* * * * *